United States Patent [19]

Brody

[11] Patent Number: 4,518,744

[45] Date of Patent: May 21, 1985

[54] PROCESS OF MELT SPINNING OF A BLEND OF A FIBRE-FORMING POLYMER AND AN IMMISCIBLE POLYMER AND MELT SPUN FIBRES PRODUCED BY SUCH PROCESS

[75] Inventor: Harry Brody, Harrogate, England

[73] Assignee: Imperial Chemical Industries PLC, Hertfordshire, England

[21] Appl. No.: 439,295

[22] Filed: Nov. 4, 1982

[30] Foreign Application Priority Data

Nov. 23, 1981 [GB] United Kingdom ..... 8135250

[51] Int. Cl.[3] ..... D01D 5/02

[52] U.S. Cl. ..... 525/184; 264/176 F; 264/211; 264/349; 264/DIG. 29

[58] Field of Search ..... 264/147, 176 F, 349, 264/211; 525/931, 179, 187, 408, 184

[56] References Cited

U.S. PATENT DOCUMENTS

| | | | |
|---|---|---|---|
| 3,475,898 | 11/1969 | Magat et al. | 428/372 |
| 3,979,496 | 5/1976 | Schwarz | 264/168 |
| 4,123,490 | 10/1978 | Gibbon | 264/147 |

FOREIGN PATENT DOCUMENTS

| | | | |
|---|---|---|---|
| 0047464 | 3/1982 | European Pat. Off. . | |
| 44-22530 | 9/1969 | Japan | 264/176 F |
| 48-4566 | 2/1973 | Japan | 264/176 F |
| 54-1362 | 1/1979 | Japan | 525/408 |
| 56-85420 | 7/1981 | Japan . | |
| 56-91013 | 7/1981 | Japan . | |
| 172074 | 6/1982 | Japan . | |
| 172075 | 6/1982 | Japan . | |
| 172586 | 6/1982 | Japan . | |
| 956833 | 4/1964 | United Kingdom . | |
| 1069993 | 5/1964 | United Kingdom | 264/176 F |
| 1073067 | 6/1967 | United Kingdom | 525/408 |
| 1070613 | 6/1967 | United Kingdom | 525/408 |
| 1406810 | 9/1975 | United Kingdom . | |

*Primary Examiner*—Donald E. Czaja
*Assistant Examiner*—Hubert C. Lorin
*Attorney, Agent, or Firm*—Cushman, Darby & Cushman

[57] ABSTRACT

A process of melt spinning a fibre-forming thermoplastic polymer, more particularly polyethylene terephthalate, polyhexamethylene adipamide or polypropylene, at a minimum wind up speed of 2 kilometers per minute in which there is added to the fibre-forming polymer, between 0.1% and 10% by weight of another polymer which is immiscible in a melt of the fibre-forming polymer, such other polymer having a particle size of between 0.5 and 3 microns in the melt with the fibre-forming polymer immediately prior to spinning and novel melt spun fibres produced by such a process and in which the other polymer is in the form of microfibrils.

5 Claims, 9 Drawing Figures

Figure 1:
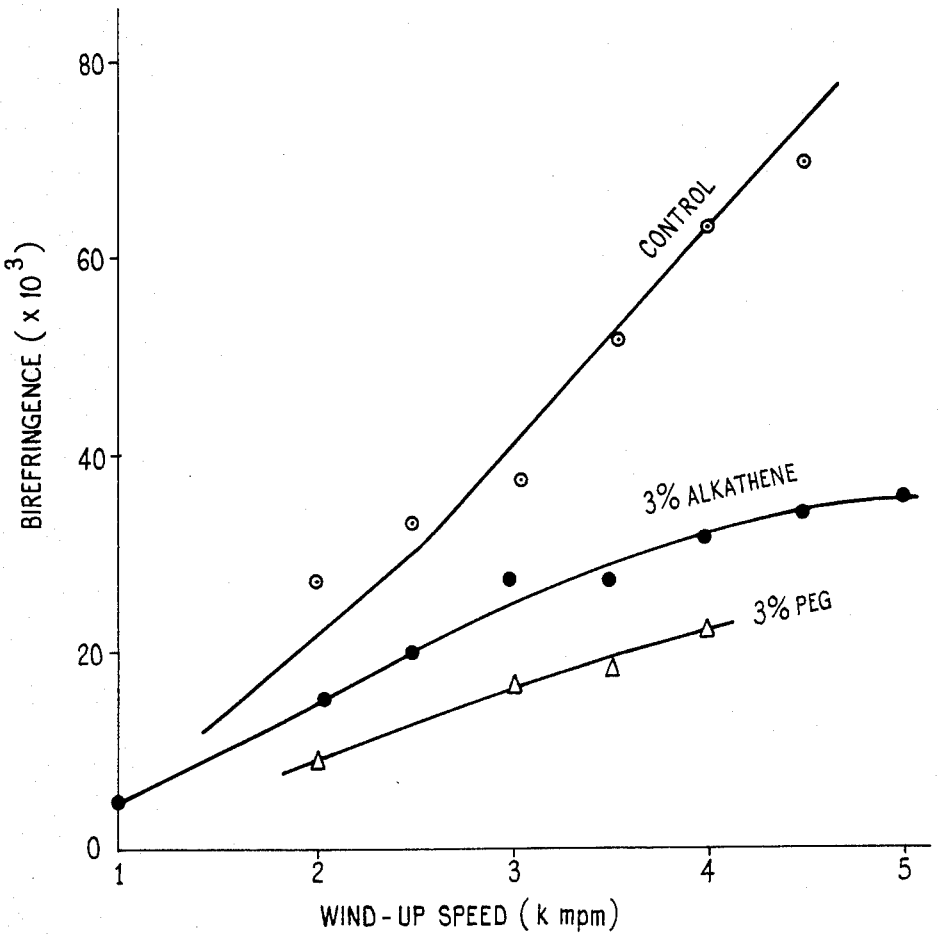

STRESS AT 50% STRAIN (cN/tex)
35
30
25
20
15
10
5
0
1
2
3
4
5
6
WIND-UP SPEED (K mpm)
CONTROL
6% NYLON
CONTROL
6% NYLON

PROCESS OF MELT SPINNING OF A BLEND OF A FIBRE-FORMING POLYMER AND AN IMMISCIBLE POLYMER AND MELT SPUN FIBRES PRODUCED BY SUCH PROCESS

This invention relates to the manufacture of synthetic fibres by melt spinning and drawing a blend of a fibre-forming polymer and an immiscible polymer.

Recently there have been a number of disclosures relating to the production of melt-spun synthetic fibres from a fibre-forming polymer in which another polymer is added to the fibre-forming polymer before it is spun.

Japanese Pat. No. 56-85420 (Teijin KK) is concerned with the production of an undrawn polyamide yarn containing between 0.5% and 10% by weight of a bisphenol-type polycarbonate having a degree of polymerisation of 20 or more. The patentee states that it is not sufficiently clear how the addition of the polycarbonate is able to achieve its characteristic effect of improved productivity but suggests that it is due to peculiarities of the polycarbonate chemical structure, its non-crystallinity and low mobility and its mutual solubility in the polyamide molecules which results in a dispersed polymer blend which has the compromise properties of both constituents and which appear as important features of the fibre.

Japanese Pat. No. 56-91013 is concerned with an undrawn melt-spun polyester yarn containing between 0.5% and 10% by weight of a styrene-type polymer with a degree of polymerisation of 20 or more. The patentee states that the improved productivity achieved by adding the styrene-type polymer to the polyester is due, in part, to the mutual solubility of this polymer in the polyester molecules.

European Patent Application No. 0047464 (published Mar. 17, 1982) is concerned with an undrawn, melt-spun, polyester yarn, the productivity of which is enhanced by adding to the polyester, from 0.2 to 10% by weight of a polymer (excluding a styrene-type polymer) having a recurring unit structure represented by the following formula:

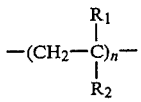

wherein $R_1$ and $R_2$ stand for substituents consisting of optional atoms selected from C, H, N, S, P and halogen atoms, with the proviso that the sum of the molecular weights of $R_1$ and $R_2$ is at least 40, and n is a positive integer, and having a molecular weight of at least 1,000. The patentee considers that the effect of improved productivity is achieved for the following reasons. First is a chemical structural feature of the additive polymer created by the presence of bulky chains. Second is the compatibility of the additive polymer with the polyester. Third is the mix characteristic of the additive polymer and the fibre-forming polymer in the blend. He further states that it is necessary to make sure that mixing is performed sufficiently so that the additive polymer is finely and uniformly dispersed in the polyester and furthermore if the diameter of the additive polymer particles exceeds 1 micron the effect is not achieved.

European Patent Application No. 0049412 (published Apr. 14, 1982) is concerned with a polyester multifilament yarn consisting of two different groups of filaments, one group being melt-spun from a polyester containing from 0.4 to 8% by weight of a styrene type polymer, a methacrylate type polymer or an acrylate type polymer. The addition of the styrene type polymer, methacrylate type polymer or acrylate type polymer to the polyester causes a drastic reduction of the orientation of each filament and it is presumed that this is because of the peculiar chemical structure of the additive polymer and because it is dispersed in the polyester matrix in the form of fine particles having a size smaller than 500 Å.

In Example III of British Patent Specification No. 1 406 810, there is described a polyethylene terephthalate yarn containing 5.5% of polyoxyethylene glycol having a molecular weight of 20,000 which has been spun at a wind up speed of 2835 meters per minute. Such yarns are also described in British Patent Specification No. 956,833. There is no mention in this Example or elsewhere in the Specification that the specific polymer used forms a two phase melt with the polyethylene terephthalate used and because this is not mentioned a critical particle size cannot be assumed.

In U.S. Pat. No. 3,475,898 there is disclosed a blend of polyethylene glycol with a polyamide which is melt spun to form an antistatic filament. From the draw ratios given in the Examples it can be inferred that the wind up speed of the spun filaments was not substantially greater than 1 kilometer/minute. The specification proposes a preferred particle size range in the melt blend of between 2 and 5 microns in order to achieve adequate conductivity in the filament.

According to this invention we provide a process of melt spinning a fibre-forming thermoplastic polymer at a minimum wind up speed of 2 kilometers per minute in which, before melt spinning, there is added to the fibre-forming polymer, between 0.1% and 10% by weight of another polymer which is immiscible in a melt of the fibre-forming polymer, such other polymer having an average particle size of between 0.5 and 3 microns in the melt with the fibre-forming polymer immediately prior to spinning whereby there is at least a 20% suppression of wind up speed compared with the process carried out with the same throughput but in the absence of the added polymer, suppression of wind up speed being defined hereinafter.

By an "immiscible polymer" we mean that at the spinning temperature such a polymer forms a two phase melt with the fibre-forming thermoplastic polymer. Microscopic examination and optical photographs of such a melt show a two phase system in which the immiscible polymer is in the form of circles (indicating spherical particles) dispersed in the continuous, fibre-forming, polymer matrix.

However we wish the term "an immiscible polymer" to exclude a liquid crystal polymer, ie the additive polymers used in the invention do not form an anisotropic melt in the temperature range at which the thermoplastic polymer may be melt spun. This anisotropic condition may form when a liquid crystal polymer is heated or by the application of shear to the polymer, although in the latter case it must persist for a few seconds.

The extensional viscosity of the immiscible polymer must be such that the molten spheres of the additive polymer immediately prior to spinning, deform into microfibrils along the spinning threadline.

We also provide, therefore, melt spun fibres of a fibre-forming thermoplastic polymer containing between 0.1% and 10% by weight of the defined other polymer such other polymer being present in the melt spun fibres as microfibrils. These microfibrils have an aspect ratio ie length/diameter ratio which is very high eg typically greater than 50 and such microfibrils will have diameters of about 0.5 micron.

The process of the invention is suited to the melt spinning of the more common fibre-forming polymers such as polyesters, polyamides, copolyesters, copolyamides, or polyolefines, for example polyethylene terephthalate and its copolyesters, polyepsilon-caproamide, polyhexamethylene adipamide, polypropylene and the like. However, we have found that the process is particularly suited to the melt spinning of polyethylene terephthalate, polyhexamethylene adipamide and polypropylene.

Suitable immiscible polymers are polyolefines, such as polyethylene and polypropylene; condensation polymers such as polyamides, and copolyamides, for example polyepsilon-caproamide, polyhexamethylene adipamide and the like; and polyethylene glycol.

One advantage of the process is that it allows significant productivity gains to be achieved. The effect of blending the immiscible polymer with the fibre-forming polymer is that of wind up speed suppression (WUS) ie the properties of the spun fibre are those that would be obtained from fibre spun at lower wind up speed. As the WUS increases in normal spinning, in the absence of the immiscible polymer, certain properties of polyethylene terephthalate, polyhexamethylene adipamide and polypropylene increase or decrease continuously. These properties can therefore be used to measure the degree of WUS suppression.

We have said above that the extensional viscosity of the immiscible molten spheres of the additive polymer must be such that these spheres deform into microfibrils along the spinning threadline so that they are present in such a form in the melt spun fibres. It is believed that it is the conversion of the spheres of additive polymer into microfibrils and the extent of this deformation that produces the change in rheology responsible for wind up speed suppression. If the additive polymer remains in a spherical form in the spun fibres then wind up speed suppression will not occur.

In the case of polyethylene terephthalate, the two major properties that can be used are birefringence and extension-to-break of the spun fibre determined by an Instron. The birefringence normally increases smoothly with WUS, so that a reduction of birefringence at a given WUS is indicative of WUS suppression. The extension-to-break decreases with WUS, so that in this case an increase of extension is indicative of WUS suppression. For polyethylene terephthalate there is another property of spun fibres which passes through a maximum with WUS, and which is also governed by the WUS, and this is spun yarn boiling water shrinkage (SYS). This cannot be related quite so quantitatively as birefringence and extension-to-break to express the degree of WUS suppression, but the semi-quantitative effects are similar.

For polyhexamethylene adipamide, the extension-to-break can be used in a similar manner to polyethylene terephthalate. On the other hand there are complications in using the birefringence since the birefringence of spun fibres tends to level out at high WUS where the effectiveness of the immiscible polymer is greatest, and also there are post spinning increases in birefringence which complicate the measurement. For these reasons, birefringence is not a suitable parameter for establishing whether WUS suppression has occurred. Instead, another parameter which increases smoothly with WUS, namely the true stress at 50% strain derived from the Instron stress/strain curve of the spun fibre is used.

In the case of polypropylene, the true stress at 50% strain derived from the Instron stress/strain curve of the spun fibre may also conveniently be used as an indication of WUS suppression.

Another advantage is that novel rough surfaced fibres may be produced by the process of the invention.

Fibres of a fibre-forming polymer such as a polyester, a polyamide or polypropylene produce by extrusion through fine orifices by the melt spinning technique normally possess a smooth shiny surface. Although the cross section of the filamentary fibres may be other than circular, fabrics made from such fibres possess a slick hand and are cold to the touch. In addition if the fibres are made into staple fibres, the smooth surface makes for more difficult working of the staple fibres into spun yarn. The desired fibre cohesiveness is not available. Natural fibres such as wool and cotton have a rough surface which tends to interlock in the spun yarn. The rough surface also provides better heat insulation and lends to a warm-to-the touch quality to fabrics made from such yarn.

Attempts have been made to provide synthetic fibres with a rough surface by either incorporating a particulate filler such as talc, metal whiskers, alumina or silica carbide, silica or a blowing agent in the fibre-forming polymer before it is spun or by rapidly cooling the fibres with water or solvent. The process of the invention provides fibres of a polyester, a polyamide or polypropylene having a rough surface without recourse to such techniques.

The invention will now be described with reference to the following Examples. In these Examples the additive polymer is an immiscible polymer and forms a two phase melt with the fibre-forming polymer.

Also in all of the examples the additive polymer has an average particle size of between 0.5 and 3 microns in the melt with the fibre-forming polymer immediately prior to spinning.

Furthermore, the extensional viscosity of the additive polymers used in the following examples was such that under the conditions of the examples, the additive polymer exists prior to spinning as molten spheres and in the melt spun fibres as microfibrils.

EXAMPLE 1

A commercial grade of polyethylene—Alkathene Grade 23—was used as the additive polymer. It had a melt flow index of 200 and a melt viscosity of 12 $Ns/m^2$ at $10^4$ $N/m^2$ and 180° C. 3% by weight was compounded with a commercial grade of polyethylene terephthalate (PET) with a melt viscosity 320 $Ns/m^2$ at $10^4$ $N/m^2$ and 180° C. in an MPM single screw extruder with a 32:1 L/D ratio operating at 40 rpm with a feed zone at 230° C., barrel temperatures at 280°, 270°, 265° and 175° C. and die temperature 250° C.

The polymer mix was extruded into a $\frac{3}{8}$ inch diameter lace which was water quenched and cut.

As a control, PET, without the low viscosity polymer, was extruded in a similar manner.

Figure 2:
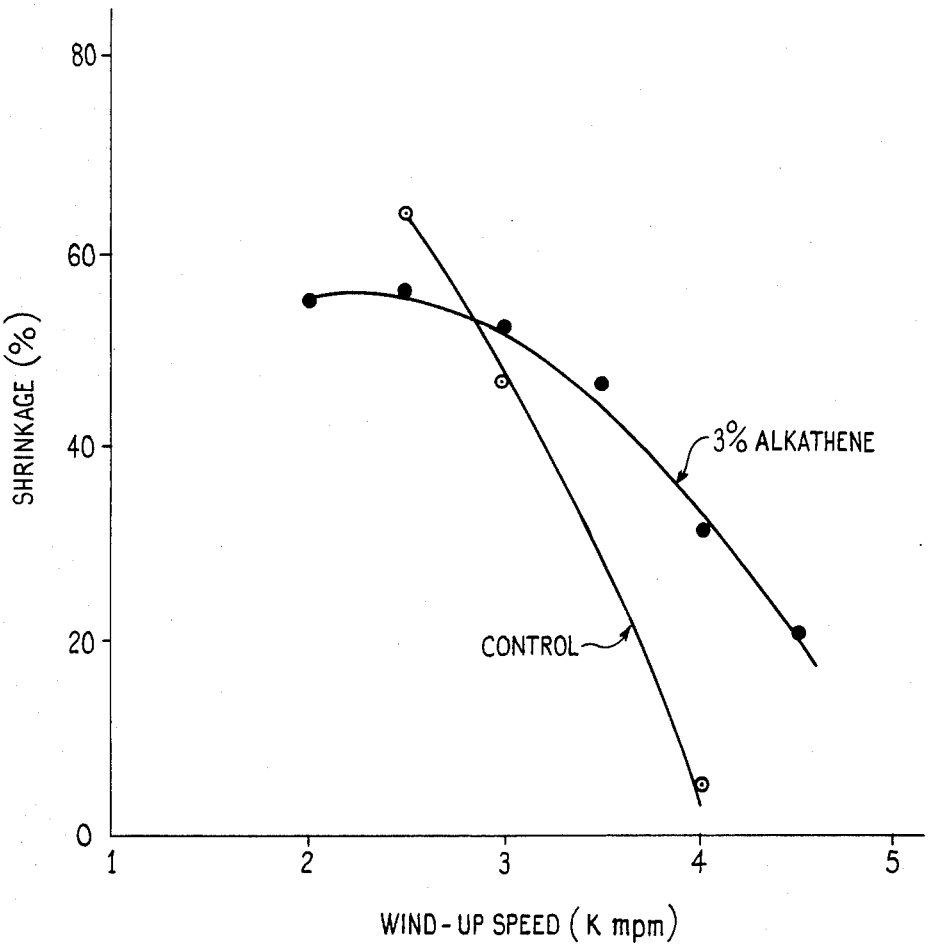

The polymer mix and PET alone were melt spun on a rod spinner through 15 thou spinneret holes at 40 grams/hr/hole, i.e. at the same throughput, with no deliberate quenching. After cooling, the filaments so formed were wound up at various wind up speeds in the range 2 to 5 kilometers per minute without adjustment of spinning rate so that the higher wind up speeds yielded finer fibres. The extruder temperature was 300° C. The effect of polyethylene on birefringence and SYS is shown in Table 1 and in FIGS. 1 and 2 which are derived from the results shown in Table 1. It will be noted that a wind up speed suppression of at least 20% occurs at a wind up speed of 2 kilometers per minute; more particularly, when 3% alkathene is spun at a wind up speed of 2 kilometers per minute the corresponding lower wind up speed is 1.6 kilometers per minute, i.e. a 20% suppression in wind up speed and increases in extent with increasing wind up speed. At 5 kilometers per minute the wind up speed is almost halved.

EXAMPLE 2

Polyethylene glycol—Carbowax 20M—was used as the additive polymer. It had a melt viscosity of 15 $Ns/m^2$ at $10^4$ $N/m^2$ and 100° C. which indicates an extremely low melt viscosity at the spinning temperature.

A blend was formed by adding 3% by weight of Carbowax 20M to the same commercial grade of PET as was used in Example 1 at the start of the polymerisation cycle. The blend was spun on a rod spinner through 15 thou spinneret holes at 40 grams per hour per hole, i.e. at the same throughput, with no deliberate quenching. There was no adjustment for spinning rate, so that the higher wind up speeds yielded finer filaments. The extrusion temperature was 300° C.

The highest wind up speed at which continuous spinning was possible was 2 kilometers per minute. At higher wind up speeds the threadline broke down as soon as a small portion had been wound up. It is assumed that these fibre samples had been travelling at the measured wind up speed. The effect of polyethylene glycol on birefringence is shown in Table 1 and in FIG. 1 which is derived from the results shown in Table 1.

It will be seen that the wind up speed suppression achieved with polyethylene glycol is greater than with polyethylene, at 4 kilometers per minute the wind up speed being halved.

TABLE 1

| POLYMER | WUS (K mpm)* | BIRE-FRINGENCE ($\times 10^3$) | EQUIVALENT LOWER WUS (K mpm)* | SYS (%) |
|---|---|---|---|---|
| CONTROL | 2.0 | 27.0 | — | — |
| | 2.5 | 33.1 | — | 64.5 |
| | 3.0 | 36.9 | — | 46.7 |
| | 3.5 | 51.6 | — | — |
| | 4.0 | 63.3 | — | 4.8 |
| | 4.5 | 70.1 | — | — |
| 3% ALKA-THENE | 1.0 | 4.6 | — | — |
| | 2.0 | 14.4 | 1.6 | 55.7 |
| | 2.5 | 19.2 | 1.9 | 56.3 |
| | 3.0 | 26.2 | 2.2 | 52.6 |
| | 3.5 | 27.0 | 2.4 | 40.5 |
| | 4.0 | 31.6 | 2.6 | 32.0 |
| | 4.5 | 34.3 | 2.7 | 21.0 |
| | 5.0 | 35.5 | 2.8 | — |
| 3% PEG | 2.0 | 8.7 | 1.2 | — |
| | 3.0 | 16.8 | 1.6 | — |
| | 3.5 | 18.1 | 1.8 | — |
| | 4.0 | 23.0 | 2.0 | — |

*Kilometers per minute.

EXAMPLE 3

This Example was carried out to show that the thermal history and temperature of the spinning threadline are vitally important in order to achieve wind up speed suppression. If the threadline is too hot, very little wind up speed suppression may be obtained. However the amount of wind up speed suppression can be increased by factors which produce a colder threadline, such as a lower extrusion temperature and the use of a quench of, for example, air. The colder threadline activates the additive polymer (in this Example, polyethylene), presumably by increasing the net viscosity ratio of the host polymer (polyethylene terephthalate) to the low viscosity polymer.

A blend of polyethylene and polyethylene terephthalate was formed as in Example 1. A control of polyethylene terephthalate was also formed in the same manner.

The blend and control were spun on a lab melt spinner using 9 thou spinnerets and an extrusion temperature of 300° C. The wind up speed was kept constant at 4 kilometers per minute with a throughput of 94 grams/hour/hole. As the degree of wind up speed suppression was increased by cooling the threadline, the majority of the fibres examined had a corresponding lower birefringence. However, a diameter variability was introduced with occasional low diameters actually having a higher birefringence than the control. This is a consequence of blend non-uniformity which produced flow fluctuations in the spinning threadline. With this blend, wind-up speed suppression was accompanied by a larger spread of spun diameters than the control. The control fibre dimensions lay between 16 microns and 23 microns. For purpose of comparison therefore the values of birefringence of the blend fibres have been confined to this range.

The results are shown in Table 2. It can be seen that the polyethylene becomes increasingly activated as the threadline is made cooler.

TABLE 2

| POLYMER | EXTR TEMP (°C.) | QUENCH | BIREFRINGENCE ($\times 10^3$) |
|---|---|---|---|
| CONTROL | 300 | No | 63.3 |
| | 285 | Yes | 62.2 |
| 3% ALKATHENE | 300 | No | 52.2 |
| | 285 | No | 46.3 |
| | 300 | Yes | 45.0 |
| | 285 | Yes | 37.1 |

EXAMPLE 4

6% by weight of a commercial grade of polyethylene—Alkathene Grade 23 (as used in Example 1) was blended with Imperial Chemical Industries PLC SGS grade nylon 66 on a Plaston single screw extruder with a 1.5 inch diameter nylon screw of 30:1 L/D ratio. The viscosity of the nylon 66 was 80 $Ns/m^2$ at $10^4$ $N/m^2$ and 285° C. The screw feed was 50 rpm with the feed zone at about 290° C. and observed barrel temperatures from feed zone to die end of 296° C., 299° C., 289° C., 294° C., 299° C. A lace of 0.25 inch diameter was extruded into a water bath by a haul off and thence to a lace cutter. The average output rate was 123 grams per minute.

As a comparative example SGS grade nylon 66 was blended with 6% by weight of Santicizer, a solid sulphonamide plasticiser sold by Monsanto. Also, as a control, nylon 66 alone was also passed through the extruder. The nylon was dried overnight in a vacuum oven at 90° C. 1 kg batches were prepared, the first 200 grams of which were dumped to clear out the remains of the previous batch.

The blends and the nylon control were spun on a rod spinner through 15 thou spinneret holes without an air quench or a steam conditioning tube. The throughput was maintained at 34 grams/hour/hole for the blends and the control. By increasing wind up speed, finer fibres were produced as before.

A number of difficulties had to be overcome in order to achieve a good spinning technique for nylon 66. It was found that in spite of pre-drying the nylon overnight, the preparation of a candle at 240° C. (10 minutes) apparently caused a considerable reduction in molecular weight as evidenced by a very watery extrudate. It was decided to spin the chip directly, and this proved to be successful and time-saving. The pack could be used a number of times as long as it was flushed out with polypropylene at the end of a spin (at first residual nylon left in the pack degraded even when the spin was finished, and the pack could only be used once).

Another difficulty arose because a steam conditioner was not used. When the yarn was wound directly on to the capstan at moderate wind up speeds it spontaneously extended during the spin and was thrown outwards from the capstan by centrifugal force, making it impossible to wind up. This did not seem to happen at higher wind up speeds, but since the polyethylene effectively lowers the wind up speed it was imperative to solve this problem. It was found that the difficulty could be avoided if spin finish was omitted and the nylon was wound up dry directly onto the capstan. This means that the yarn could not be rewound on a bobbin but had to be removed as a hank for subsequent testing. There was an unexpected major benefit. For Instron testing it was necessary to dissect portions of the hank and determine the decitex of each portion individually by weighing. The decitex used as 20–100 times the normal rather low yarn decitex, which was limited by throughput/wind up speed considerations. This led to excellent reproducibility on Instron testing by avoiding errors due to decitex variability along the yarn.

There was concern that omitting the application of moisture during spinning might lead to an unstable ageing situation where the birefringence of the nylon gradually changed with time. However, we established that at 3.6 kilometers per minute, the birefringence of a sample chopped from the spinning threadline above the conditioner and immersed in Euparol on a slide rose to 75% of the package value in 3 minutes, and reached the package value within 3 hours. It is well known that dry nylon absorbs moisture from the air very rapidly. Chappel et al (see *J Appl Chem,* 14, 12 (1964)) have found that freshly spun or dried nylon of 90 microns diameter reached its equilibrium moisture content after 3 hours when exposed to the ambient atmosphere, attaining 80% of this after one hour. Our maximum spun diameter was only about 25 microns. To be completely sure, we used a minimum lapse time of one day after spinning before testing, during which the nylon was kept in a conditioned laboratory at 50% RH and 70° C.

Figure 3:
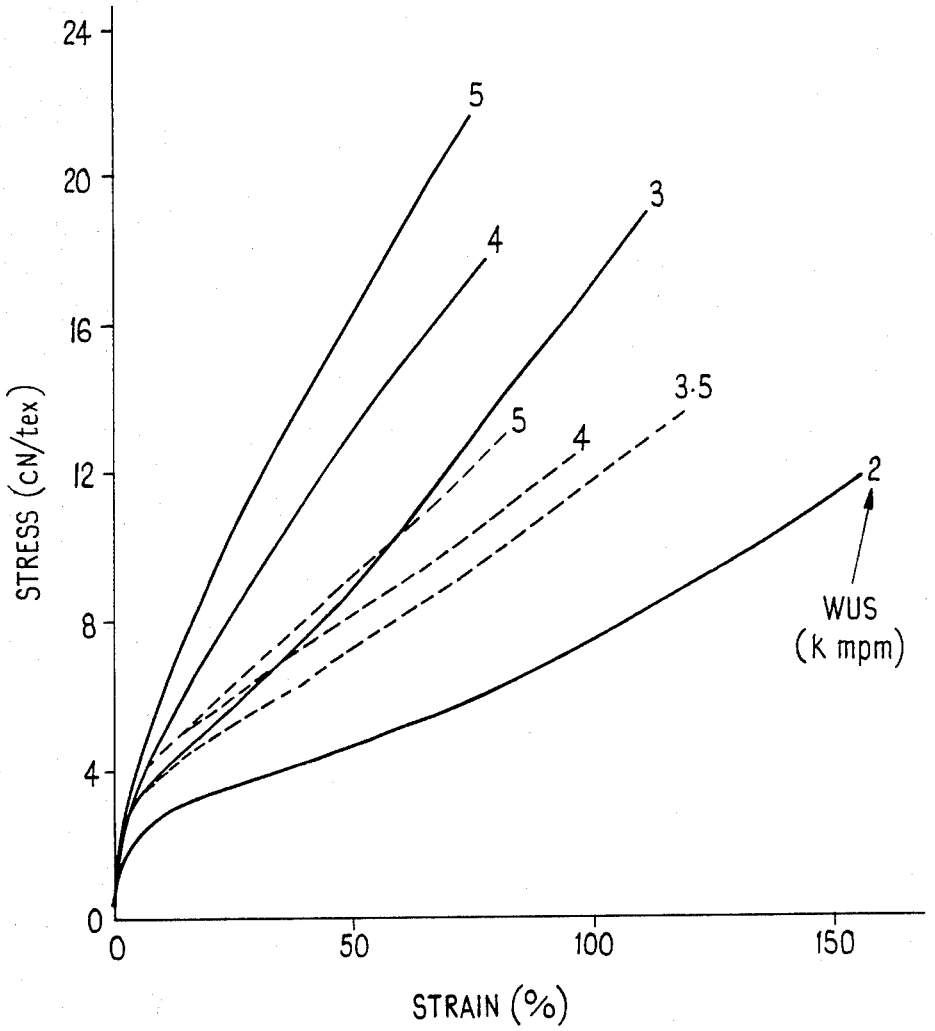
Figure 4:
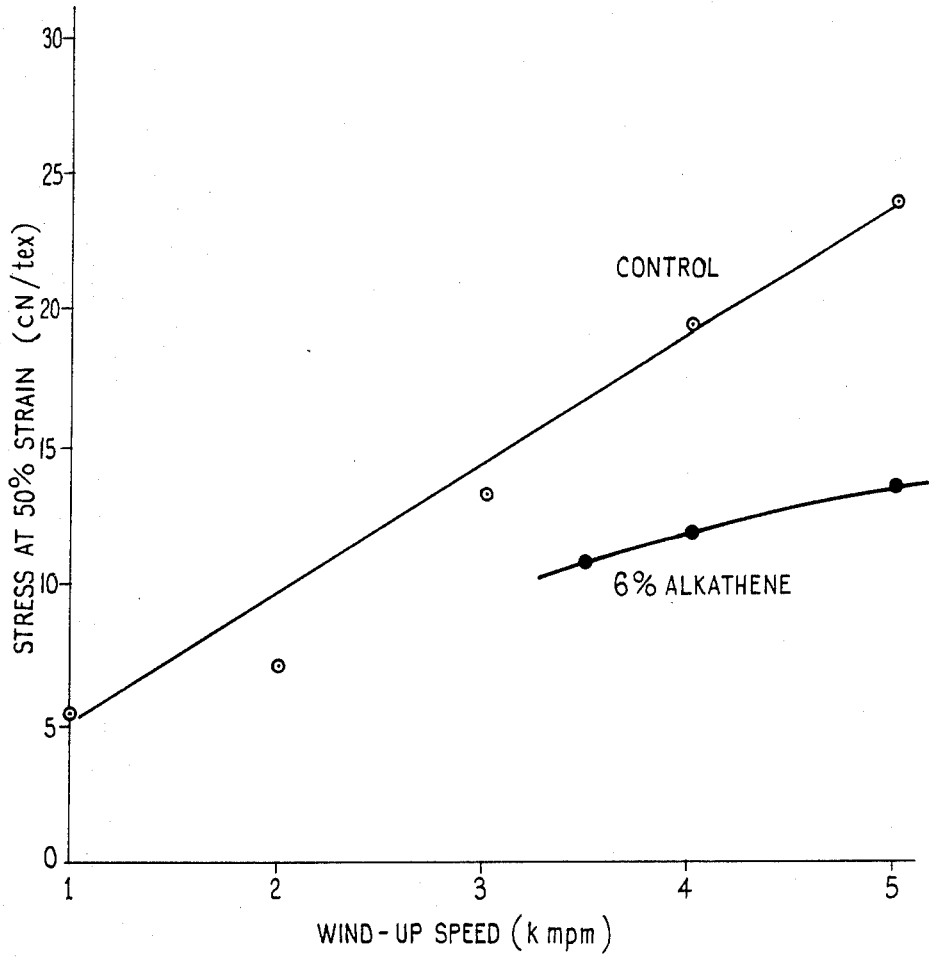

The effect of 6% by weight of polyethylene on the specific stress-strain curves is illustrated in FIG. 3 in which the solid lines are the control and the dashed lines are the blend. The true stress at 50% strain is given in Table 3 and plotted in FIG. 4. It will be seen that the degree of wind up speed suppression obtained is large and increases with wind up speed, almost halving the wind up speed at 5 kilometers per minute. The extension of the polyethylene blends is higher than that of the control, and this would give a productivity increase if it translated into hot draw ratio for nylon POY, as shown in Table 3.

If a spun filament has a percent extension-to-break of E, then the maximum draw ratio to which it can subsequently be subjected is roughly (1+E/100). If a second spun filament has a larger extension-to-break E′ then it can be subjected to a larger draw ratio, roughly (1+E′/100). To make drawn filaments of equal decitex at these maximum draw ratios the spun filaments must therefore have decitexes of d(1+E/100) and d(1+E′/100) respectively. If both filaments are spun at the same speed their production rates are proportional to these decitexes and the percentage increase in productivity of the second filament is $$\frac{(1 + E'/100) - (1 + E/100)}{(1 + E/100)} \times 100\%$$

This is the function listed in Table 3 (and subsequently in Tables 4, 6 and 8) as the % increase in productivity.

In comparison Santicizer gives a very small degree of wind up speed suppression at high wind up speed but lowers the extension below that of the control. (A different control was used for the Santicizer because this blend was made at a different time). An important factor affecting the degree of wind up speed suppression by polyethylene was the back pressure in the spinning pack. For the results in Table 3 and FIG. 4 this back pressure was low at about 20 psi. When the pack had been used a number of times this pressure was large at 200–340 psi and no wind up speed suppression was obtained.

TABLE 3

| POLYMER | WUS (K mpm)* | TRUE STRESS AT 50% STRAIN (cN/Tex) | EQUIV LOWER WUS (K mpm)* | EXTN (%) | PRODUCTIVITY INCREASE (%) |
|---|---|---|---|---|---|
| CONTROL (FOR ALKATHENE) | 1 | 5.4 | — | 200 | — |
| | 2 | 7.1 | — | 156 | — |
| | 3 | 13.5 | — | 110 | — |
| | 4 | 19.8 | — | 78 | — |
| | 5 | 24.6 | — | 75 | — |
| 6% ALKATHENE | 3.5 | 11.1 | 2.2 | 119 | 18 |
| | 4.0 | 12.3 | 2.5 | 96 | 10 |
| | 5.0 | 14.1 | 2.9 | 82 | 4 |
| CONTROL (FOR SANTICIZER) | 1 | 6.9 | — | 198 | — |
| | 2 | 11.3 | — | 140 | — |
| | 3 | 17.7 | — | 108 | — |
| | 4 | 27.0 | — | 66 | — |
| 6% SANTICIZER | 1 | 6.5 | 1 | — | — |
| | 2 | 12.0 | 2 | 125 | — |

TABLE 3-continued

| POLYMER | WUS (K mpm)* | TRUE STRESS AT 50% STRAIN (cN/Tex) | EQUIV LOWER WUS (K mpm)* | EXTN (%) | PRODUCTIVITY INCREASE (%) |
|---|---|---|---|---|---|
| | 3 | 15.9 | 2.7 | 90 | — |
| | 4 | 20.2 | 3.5 | 72 | — |
| | 5 | 28.2 | 4.2 | 62 | — |

*Kilometers per minute.

Figure 5:
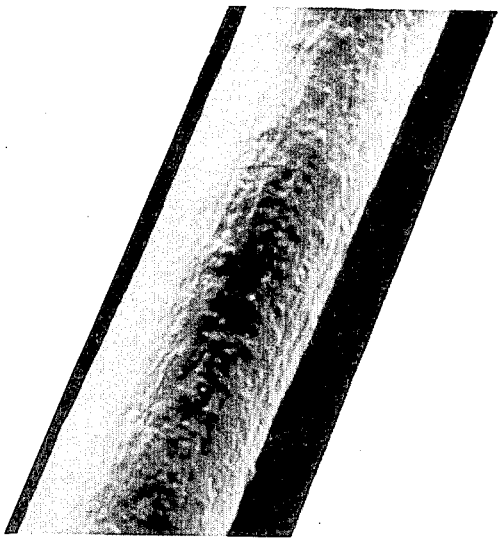

Those fibres spun from a 6% polyethylene/nylon 66 blend had a novel, rough, pitted surface as shown in FIG. 5 which shows the surface of a fibre which has been spun at 4K mpm.

The equivalent control fibre at the same magnification is a smooth featureless cylinder. Fabrics made from the blend fibres had a pleasant appearance and handle.

EXAMPLE 5

A commercial grade of nylon 66—Imperial Chemical Industries A100 grade nylon 66—was used as the additive polymer in the same PET used in Example 1. The RV of this nylon 66 was 47. (RV is the Relative Viscosity of an 8.4% solution of the nylon in 90% formic acid compared with the viscosity of 90% formic acid itself) 3% by weight was compounded in an extruder with the same PET used in Example 1, using the same extruder conditions. The nylon was dried overnight at 90° C. in a vacuum oven before blending. As a control PET without the nylon was extruded in a similar manner.

The polymer blend and PET alone were dried for 4 hours at 170° C. and then spun on a rod spinner through 9 thou spinneret holes at 96 and 240 grams/hr/hole with no deliberate quenching. The extrusion temperature was 295° C. After cooling, the filaments so formed were wound up at various wind-up speeds without adjustment of spinning rate so that higher wind-up speeds yielded finer fibres. The effect of the nylon additive on the birefringence and extension of the PET is shown in Table 4. Because of different spinning conditions the control values are slightly different from those given in Table 1. The productivity increase is calculated as in Example 4.

It can be seen that spinning conditions are very important for wind-up speed suppression in this nylon/-PET system, where the blend has been made on an extruder prior to spinning. Whereas considerable suppression was obtained at a throughput of 96 grams/hr-/hole, with the wind-up speed about halved at 5 kilometers per minute, almost no suppression was obtained at 240 grams/hr/hole. The control values were the same at both these throughputs. It is thought that this is due to the thermal history of the threadline and that very little wind-up speed suppression can be obtained if the threadline is too hot, but it can be increased by factors which produce a colder threadline, such as lower throughput and lower extrusion temperature. As in Example 3, the colder threadline presumably activates the nylon.

TABLE 4

| POLYMER | THROUGHPUT (gm/hr/hole) | WUS (K mpm) | BIREFRINGENCE ($\times 10^3$) | EQUIVALENT LOWER WUS (K mpm) | EXTN (%) | PRODUCTIVITY INCREASE (%) |
|---|---|---|---|---|---|---|
| PET CONTROL | 96 and 240 | 1 | 5.0 | — | — | — |
| | | 2 | 20.0 | — | 226 | — |
| | | 3 | 40.0 | — | 122 | — |
| | | 4 | 62.0 | — | 80 | — |
| | | 5 | 85.0 | — | 55 | — |
| 3% NYLON (A100) | 96 | 2 | 11.5 | 1.4 | 240 | 4 |
| | | 3 | 17.2 | 1.8 | 190 | 31 |
| | | 4 | 22.6 | 2.2 | 150 | 39 |
| | | 5 | 30.0 | 2.4 | 124 | 45 |
| | 240 | 3 | 38.1 | 2.9 | 125 | 1 |
| | | 4 | 54.5 | 3.6 | 85 | 3 |

EXAMPLE 6

This example demonstrates the effect of producing a cooler threadline by using a lower extrusion temperature, as in Example 3, where the nylon/PET blend has been pre-blended on an extruder at a fixed temperature. A 3% blend of nylon 66 in PET was made on an extruder, using the same polymers as in Example 5, but this time different blending conditions were used. The extruder used was a BETOL single screw extruder which had a 19 mm diameter 'nylon screw' of 30:1 L/D ratio. The screw feed was 50 rpm, with the feed zone at 265° C., and barrel temperatures thereafter at 280° C. The nylon drying and lace extrusion were as in Examples 1 and 5.

The blend was spun on a rod spinner at 96 grams/hr-/hole and 4 kilometers per minute using the same process conditions as in Example 5, but varying the extrusion temperature. The effect on birefringence and extension are given in Table 5. It can be seen that lowering the extrusion temperature increases the degree of WUS suppression.

The results from Table 4 and Example 5 at 4 kilometers per minute, where the extrusion temperature was 295° C., do not precisely agree with the interpolated values in Table 5, but this is because the blending conditions were different from using a different extruder, and illustrates that this is another variable that can affect the degree of wind up speed suppression.

TABLE 5

| POLYMER | WUS (K mpm) | THROUGHPUT (gm/hr/hole) | EXTR TEMP. (°C.) | BIREFRINGENCE (× $10^3$) | EXTN (%) |
|---|---|---|---|---|---|
| 3% Nylon (A100) | 4 | 96 | 310 | 56.7 | 92 |
| | | | 300 | 49.6 | 105 |
| | | | 290 | 24.5 | 140 |

EXAMPLE 7

This example is designed to show that chip blends of nylon 66 with PET can be as effective as extruder blends. The nylon 66 used was A100, and was dried overnight at 80° C. The PET was dried for 4 hrs at 170° C. 0.5% and 3% chip blends with the same PET used in Example 1 were spun on a screw extruder fed spinning machine at 290° C. and 96 grams/hr/hole, using 9 thou spinnerets. There was no quenching, and higher wind-up speed yielded finer filaments. The birefringence, extensions and potential spinning productivity increase are given in Table 6 compared with the PET control spun under the same conditions. It can be seen that even as little as 0.5% nylon gives considerable wind up speed suppression. An additional 5% blend was made for evaluation at 4 kilometers per minute, and Table 6 shows that the degree of wind up speed suppression begins to level out with increasing nylon.

TABLE 6

| POLYMER | WUS (K mpm) | BIREFRINGENCE (× $10^3$) | EQUIVALENT LOWER WUS (K mpm) | EXTN (%) | PRODUCTIVITY INCREASE (%) |
|---|---|---|---|---|---|
| PET CONTROL | 1 | 6.0 | — | — | — |
| | 2 | 18.0 | — | — | — |
| | 3 | 40.0 | — | 125 | — |
| | 4 | 70.9 | — | 80 | — |
| | 5 | 100.7 | — | 60 | — |
| 0.5% Nylon (A100) | 1 | 2.2 | 0.8 | 425 | — |
| | 2 | 8.6 | 1.3 | 260 | — |
| | 3 | 20.2 | 2.1 | 180 | 24 |
| | 4 | 31.5 | 2.7 | 135 | 31 |
| | 5 | 63.0. | 3.8 | 80 | 13 |
| | 6 | 77.8 | 4.3 | — | — |
| 3.0% Nylon (A100) | 1 | 2.2 | — | 460 | — |
| | 2 | 3.3 | 0.8 | 380 | — |
| | 3 | 9.1 | 1.3 | 260 | 60 |
| | 4 | 17.1 | 1.9 | 210 | 72 |
| | 5 | 27.4 | 2.5 | — | — |
| 5.0% Nylon | 4 | 15.9 | 1.8 | 200 | 67 |

EXAMPLE 8

This example is designed to show that the higher the molecular weight or RV of the nylon additive in nylon/PET blends the greater the degree of wind up speed suppression. Using the same PET as in previous examples, dried similarly, four different nylon/PET chip blends were spun on a screw extruder fed spinning machine at 290° C., 4 kilometers per minute and 96 grams/hr/hole, using 9 thou spinnerets. The four different nylons used were: (a) SGS of initial RV 40, which had not been dried; from the residual moisture content it was estimated that the equilibrium RV after passing through the spinning machine would be about 26. This nylon RV has been called 'low'. (b) SGS, of initial RV 40, which had been dried overnight under vacuum at 80° C.; the equilibrium RV was estimated to be about 44. This nylon RV has been called 'medium'. (c) A100, of initial RV 47, which had been dried overnight at 80° C.; the equilibrium RV was estimated to be about 50. This nylon RV has been called 'high'. (d) A100, of initial RV 47, which had been dried at 170° C. for 4 hrs; the equilibrium RV was estimated to be about 57. This nylon RV has been called 'very high'.

The birefringence and extension results are given in Table 7. It can be seen that the higher the RV of the nylon, and hence the higher the molecular weight, the greater the degree of wind up speed suppression.

TABLE 7

| POLYMER | NYLON RV | ESTIMATED RV IN BLEND FIBRE | BIREFRINGENCE (× $10^3$) | EXTN (%) |
|---|---|---|---|---|
| Control | — | — | 70.9 | 80 |
| 3% Nylon | Low | 26 | 50.9 | 100 |
| | Medium | 44 | 27.2 | 145 |
| | High | 50 | 17.1 | 210 |
| | Very High | 57 | 15.3 | 215 |

EXAMPLE 9

A chip blend of 6% nylon 66 with polypropylene was made. The polypropylene was ICI grade PXC 31089 of Melt Flow Index (MFI) 20 and Molecular weight 300,000. The MFI was measured at 230° C. under a load of 2.16 Kg. The nylon was ICI grade AFA, having an initial RV of 47 (RV is the Relative Viscosity of an 8.4% solution of the nylon in 90% formic acid compared with the viscosity of 90% formic acid itself). The nylon was dried for 4 hours at 170° C. in a vacuum oven before blending. From the residual moisture content it was estimated that the equilibrium RV after passing through an extruder fed spinning machine would be about 57. The polypropylene was not dried.

This chip blend was then spun on an extruder fed spinning machine at 62 grams/hour/hole at an extrusion temperature of 300° to 305° C. through 9 thou spinnerets.

It was found that stress-strain curves offer a satisfactory basis for comparing fibres made from blends with the control fibre. In general, the stress at a given strain increases fairly uniformly, and so the true stress at a fixed strain of 50% provides a good basis for evaluating the degree of wind-up speed suppression.

Figure 6:
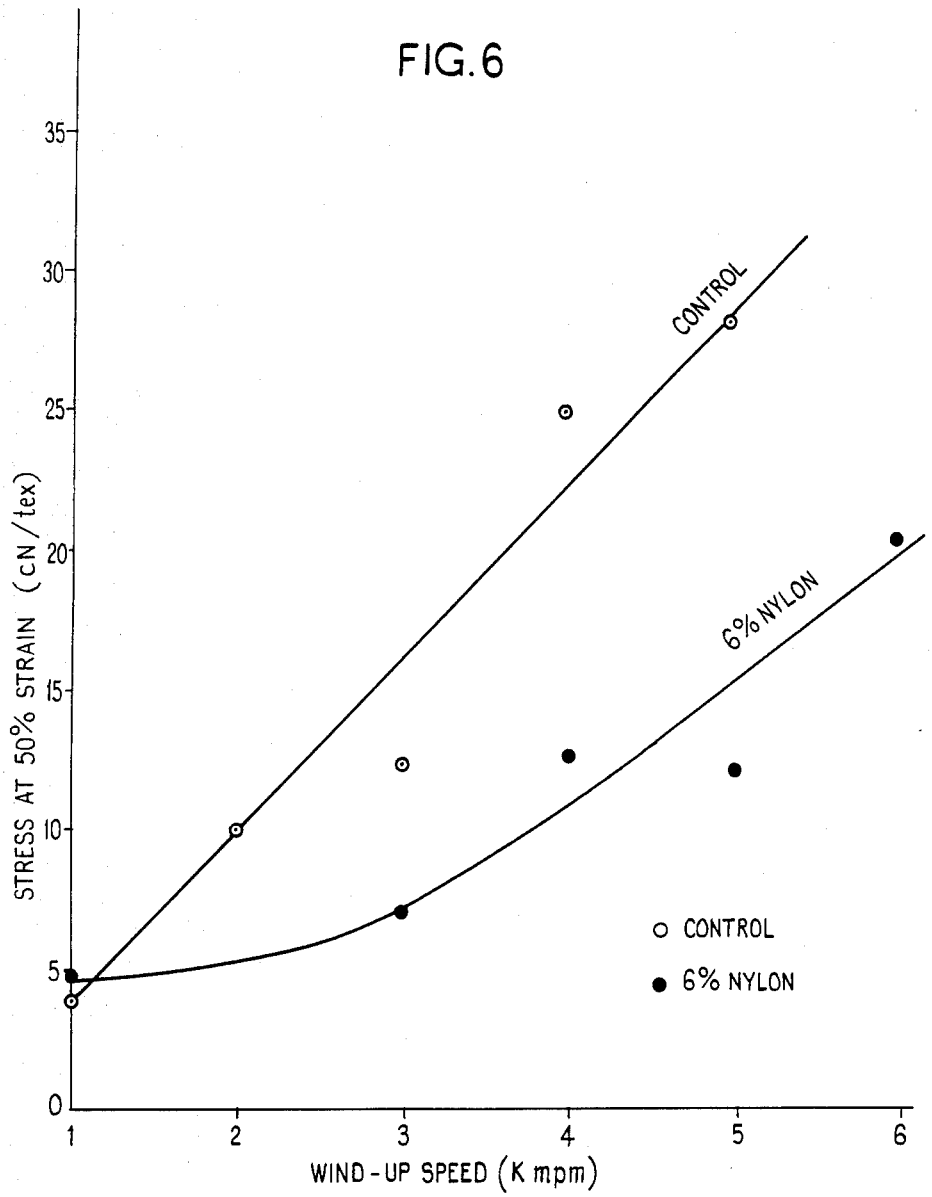

The effect of the additive on true stress at 50% strain and the calculated equivalent lower WUS are given in Table 8. The stresses are plotted graphically in FIG. 6. Also given in Table 8 are the extensions and the calculated increase in spinning productivity.

Figure 7:
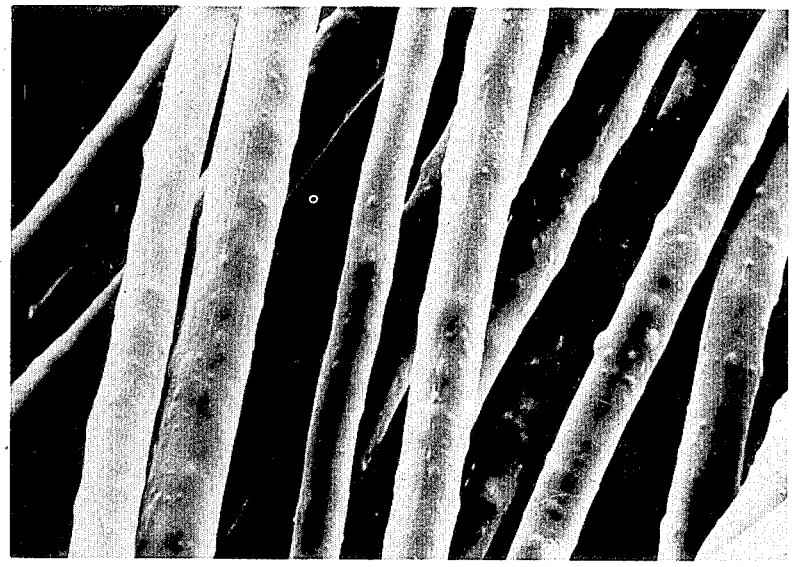

It was also found that whereas the control fibres had a smooth surface, the fibres containing 6% nylon had a very rough surface. FIG. 7 shows the surface of the blend fibre spun at 3 kilometers per minute. The equivalent control fibre at the same magnification is a smooth featureless cylinder. The rough surface of the blend fibre gave it an attractive appearance and handle and fabrics produced from the blend fibres had an improved handle.

TABLE 8

| POLYMER | WUS (K mpm)* | TRUE STRESS AT 50% STRAIN (cN/tex) | EQUIV LOWER WUS (K mpm)* | EXTN (%) | PRODUCTIVITY INCREASE (%) |
|---|---|---|---|---|---|
| CONTROL | 1 | 3.9 | — | 265 | — |
| | 2 | 9.9 | — | 145 | — |
| | 3 | 12.3 | — | 120 | — |

TABLE 8-continued

| POLY-MER | WUS (K mpm)* | TRUE STRESS AT 50% STRAIN (cN/tex) | EQUIV LOWER WUS (K mpm)* | EXTN (%) | PRODUC-TIVITY IN-CREASE (%) |
|---|---|---|---|---|---|
| | 4 | 24.9 | — | 80 | — |
| | 5 | 28.2 | — | 75 | — |
| 6% | 1 | 4.8 | — | 270 | — |
| NY- | 3 | 6.9 | 1.5 | 165 | 20 |
| LON | 4 | 12.6 | 2.4 | 100 | 11 |
| | 5 | 12.0 | 2.4 | 120 | 26 |
| | 6 | 20.4 | 3.8 | 70 | — |

*Kilometers per minute.

EXAMPLE 10

3% Alkathene 23 (an ICI grade of polyethylene with a Melt Flow Index of 200) was blended with nylon 66 (SGS, an ICI grade with a Relative Viscosity of 40. This is the viscosity of of an 8.4% solution of nylon in 90% formic acid compared to the viscosity of 90% formic acid itself) in an extruder. This was a PLASTON single screw extruder, with a 1½" 'nylon' screw, of L/D 30. The feed zone temperature was 286° C., and temperatures thereafter along the barrel were 296° C., 289° C. and 299° C. The screw speed was 50 rpm. The nylon was dried at 90° C. overnight in a vacuum oven. A nylon control without Alkathene additive was also made on the extruder under the same conditions. Lace from the extruder was run through a water bath and then to a lace cutter.

The Alkathene blend and nylon control were dried for 5 hrs at 90° C. and then spun on a rod spinner at 1 kilometer per minute through 9 thou spinneret holes without quench air at steam conditioner tube. The throughput was 74 grams/hr/hole and the extrusion temperature was 295° C. The spun decitex was 12.

Figure 8:
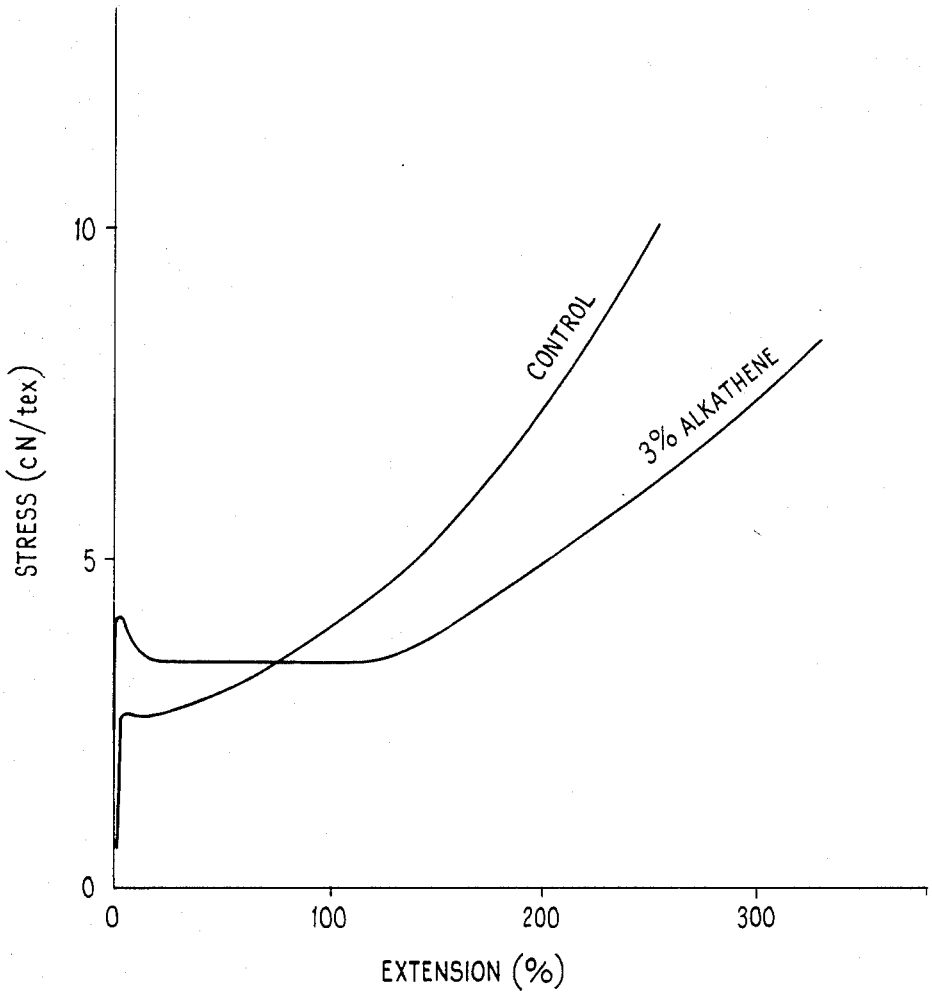

FIG. 8 shows the stress strain curves of the control and the 3% Alkathene blend. The slope of the blend stress-strain curve has been reduced and the extension increased to 330% compared with 260% for the control. This would give an increase in spinning productivity of 20%. (Obtained using the function defined in Example 4). To verify this, the spun fibres of both blend and control were drawn over a hot pin at 80° C. at a draw ratio of 10 mpm to a final extension of 40%. The blend draw ratio obtainable was 3.2 compared with 2.6 for the control, giving an increase in productivity of 23%.

Whereas the control fibre sloughed off the bobbin at this wind up speed (standard behaviour when a steam conditioner is not used), the blend fibre did not. The use of such a blend therefore eliminates the need for a steam conditioner. It is considered a possibility, although not being bound to such a hypothesis, that the threadline rheology is changed by the Alkathene to modify the temperature/time thermal history in such a way that increased crystallisation is induced in the threadline.

Figure 9:
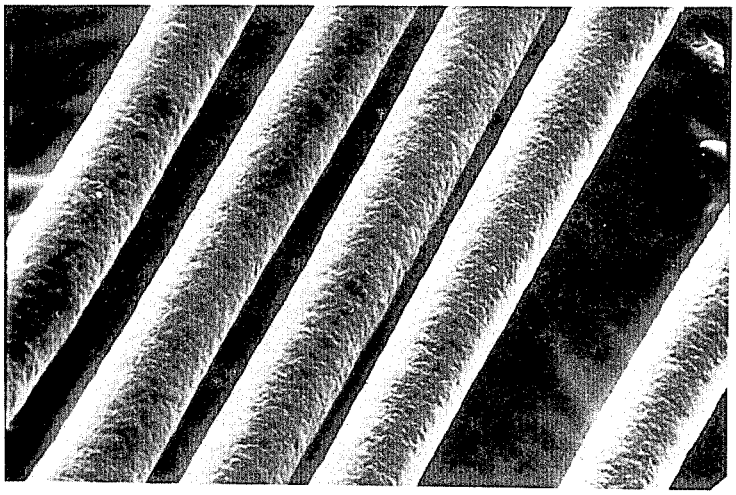

An additional and very important feature of the blend fibre was that the surface was rough and pitted, as shown in FIG. 9. The equivalent control fibre at the same magnification is a smooth featureless cylinder. The bobbin of blend fibre had a matt appearance compared with a bobbin of the control fibre. This proved very advantageous, allowing modification of the appearance and handle of articles made from these blend fibres.

I claim:

1. A process of melt spinning a fibre-forming polymer selected from the group consisting of polyethylene terephthalate, polyhexamethylene adipamide or polypropylene at a minimum wind up speed of 2 kilometer per minute, the improvement being that, before melt spinning, there is added to the fibre-forming polymer, between 0.1% and 10% by weight of another polymer which is immiscible in a melt of the fibre-forming polymer, such other polymer having an average particle size of between 0.5 and 3 microns in the melt with the fibre-forming polymer immediately prior to spinning and having an extensional viscosity such that molten spheres of the other polymer, in which form it exists immediately prior to melt spinning, deform into microfibrils during melt spinning there being in the process at least a 20% suppression of wind up speed compared with the process carried out with the same throughput in the absence of the added polymer, the term at least 20% suppression of wind up speed meaning that certain properties of the spun fibre are those that would be obtained from a fibre spun at at least a 20% lower wind up speed, such properties in the case of polyethylene terephthalate including birefringence and extension-to-break, in the case of polyhexamethylene adipamide including extension-to-break and in the case of polypropylene including the true stress at 50% strain.

2. A process of melt spinning polyethylene terephthalate as claimed in claim 1 in which the additive polymer is selected from the group consisting of polyethylene glycol and polyhexamethylene adipamide.

3. A process of melt spinning polyhexamethylene adipamide as claimed in claim 1 in which the additive polymer is selected from the group consisting of polyethylene and polypropylene.

4. A process of melt spinning polypropylene as claimed in claim 1 in which the additive polymer is polyhexamethylene adipamide.

5. Melt spun rough-surfaced fibres of polyhexamethylene adipamide produced by a process as claimed in claim 3.

* * * * *